US008717247B2

(12) United States Patent
Tikka et al.

(10) Patent No.: US 8,717,247 B2
(45) Date of Patent: May 6, 2014

(54) FRONT-END CIRCUIT FOR IMPROVED ANTENNA PERFORMANCE

(75) Inventors: Pasi Tikka, Munich (DE); Jarmo Valtonen, Oulu (FI)

(73) Assignee: EPCOS AG, Munich (DE)

( * ) Notice: Subject to any disclaimer, the term of this patent is extended or adjusted under 35 U.S.C. 154(b) by 419 days.

(21) Appl. No.: 13/040,778

(22) Filed: Mar. 4, 2011

(65) Prior Publication Data

US 2011/0210901 A1 Sep. 1, 2011

Related U.S. Application Data

(63) Continuation of application No. PCT/EP2009/064094, filed on Oct. 26, 2009.

(51) Int. Cl.

| | |
|---|---|
| ***H01Q 21/00*** | (2006.01) |
| ***H01Q 1/50*** | (2006.01) |
| ***H01Q 3/24*** | (2006.01) |

(52) U.S. Cl.

USPC ..... 343/853; 343/850; 343/876

(58) Field of Classification Search

USPC ..... 343/850, 853, 876, 860, 861; 333/17.3, 333/24 R, 32, 167, 172, 175, 262; 455/120, 455/121, 123, 125, 275, 276, 277.1, 290

See application file for complete search history.

(56) References Cited

U.S. PATENT DOCUMENTS

| | | | | |
|---|---|---|---|---|
| 5,940,040 | A | 8/1999 | Koyanagi et al. | |
| 6,055,422 | A * | 4/2000 | Saitoh | 455/277.1 |
| 6,147,651 | A | 11/2000 | Yamazaki et al. | |
| 6,985,113 | B2 * | 1/2006 | Nishimura et al. | 343/702 |
| 7,301,502 | B2 | 11/2007 | Sinasi et al. | |
| 7,349,717 | B2 * | 3/2008 | Block et al. | 455/552.1 |
| 7,724,141 | B2 * | 5/2010 | Reynolds | 340/572.7 |
| 2004/0233109 | A1 * | 11/2004 | Ying et al. | 343/700 MS |
| 2006/0022890 | A1 | 2/2006 | Chiang et al. | |
| 2008/0129639 | A1 | 6/2008 | Mitsugi | |

FOREIGN PATENT DOCUMENTS

| | | | |
|---|---|---|---|
| EP | 1 469 550 | A2 | 10/2004 |
| EP | 1 753 079 | A1 | 2/2007 |
| JP | 2000357917 | A | 12/2000 |
| JP | 2001313596 | A | 11/2001 |
| JP | 2002016515 | A | 1/2002 |
| JP | 2006310968 | A | 11/2006 |
| JP | 2009513065 | A | 3/2009 |
| WO | WO 03/096474 | A1 | 11/2003 |
| WO | 2007060734 | A1 | 5/2007 |

* cited by examiner

*Primary Examiner* — Hoang V Nguyen

*Assistant Examiner* — Patrick Holecek

(74) *Attorney, Agent, or Firm* — Slater & Matsil, L.L.P.

(57) ABSTRACT

A front-end circuit includes a signal path and a first antenna port. A first antenna switch is electrically connected to the first antenna port. A second antenna port is electrically connectable or connected to the signal path. An antenna termination circuit is electrically connected to the first antenna switch. The antenna termination includes an impedance element. The first antenna switch electrically connects the first antenna port to the antenna termination circuit when the signal path is electrically connected to the second antenna port.

19 Claims, 4 Drawing Sheets

FRONT-END CIRCUIT FOR IMPROVED ANTENNA PERFORMANCE

This application is a continuation of co-pending International Application No. PCT/EP2009/064094, filed Oct. 26, 2009, which designated the United States and was published in English, which application is incorporated herein by reference.

TECHNICAL FIELD

The present invention refers to a front-end circuit that provides mobile communication devices, such as mobile phones, with an improved antenna performance and methods for driving such a front-end circuit.

BACKGROUND

Mobile communication devices generally utilize radio frequency signals for communication with remote devices such as other mobile communication devices or base stations. Modern mobile communication devices have to fulfill many requirements. Among these are multi-band operations and multi-mode operations. Modern mobile communication devices usually are able to transmit and/or receive radio frequency signals towards or from a plurality of transmitters or receivers, respectively. Especially communication devices that operate in different frequency bands in some cases comprise a plurality of different antennas in order to be operable in different frequency bands. Such communication devices may comprise rod antennas or patch antennas, like PIFAs (planar inverted F-antenna) or PILAs (planar inverted L-antenna). As antennas are radio frequency components that interact with radio frequency signals, detrimental interaction between different antennas seems generally unavoidable.

U.S. Pat. No. 7,301,502 B2 refers to an antenna arrangement that is operable in two different frequency bands but utilizes a single antenna. In order to supply the single antenna with the ability to operate in two frequency bands, an additional antenna tuning element that is located adjacent to the antenna is provided in order to improve the antenna performance with respect to operation in two different frequency bands.

However, as every antenna generally has only one frequency band around its resonance frequency with an optimal radiation efficiency, it may be preferred to utilize at least two different antennas in order to archived satisfactory antenna performance.

SUMMARY OF THE INVENTION

In one aspect, the present invention provides a front-end circuit for use with at least two different antennas in a respective mobile communication device with an improved antenna performance.

The present invention provides a front-end circuit comprising a signal path, a first antenna port and a second antenna port. A first antenna switch is electrically connected to the first antenna port. A second antenna port is electrically connectable or electrically connected to the signal path. An antenna termination circuit is electrically connected to the first antenna switch. The antenna termination circuit has an impedance element that is selected from a resistance element, a capacitive element, an inductive element, and an LCR-circuit. The first antenna switch electrically connects the first antenna port to the antenna termination circuit when the signal path is electrically connected to the second antenna port.

When the second antenna is in use and is, for example, electrically connected to the signal path in which radio frequency signals propagate to or from the antenna, the antenna termination circuit is electrically connected to the first antenna by means of the first antenna switch. However, the first antenna may not be in use, meaning that the first antenna may not transmit or receive radio frequency signals. The inventors have found that detrimental detuning of an active antenna by an undefined inactive antenna can be reduced or even prevented. The actual amount of reduction of detrimental interaction depends on the precise impedance value of the impedance element of the antenna termination circuit.

Modern mobile communication devices that are operable in different frequency bands and/or provide multi-mode operation and that suffer from detrimental mutual interaction of different antennas comprise already intrinsically means that can be used for reducing the detrimental interaction. The second antenna that causes interaction can be utilized to reduce or prevent the primary interaction. The presented method for preventing or reducing unwanted interaction between two antennas, thus, is relatively cheap and simple to implement.

In one embodiment, the antenna termination circuit provides one selectable state or more individually selectable states chosen from an open-terminated state, a short-terminated state, and an individual-terminated state for the antenna. The number of selectable states may be 1, 2, 3 or even more. In the individual-terminated state, the first antenna switch electrically connects the impedance element of the antenna termination circuit to the first antenna port. It is preferred that the one or more out of several individually selectable states provide a 50 Ohm termination for the connected antenna. The at least one selectable state is, thus, selectable in addition to a connection with the signal path.

The wording "open-terminated state" denotes a termination whose absolute value of the termination impedance is in principle infinite, i.e., in reality very large. In contrast, the wording "short-terminated state" denotes a termination state of mainly zero impedance. The short-terminated state is in a simple embodiment realized by a direct connection of the first antenna port to ground. The open-terminated state is realized by electrically isolating the antenna port from other electric circuit components of the front-end circuit.

In many cases the most important termination state according to an embodiment of the invention, however, may be the individual-terminated state. The wording "individual-terminated state" denotes a termination state that is characterized by a fixed impedance of finite resistance and finite reactance. The front-end circuit may provide appropriate resistance, capacitive or inductive elements or networks comprising such elements in order to achieve an optimal individual-termination of the first antenna port. The front-end circuit may comprise a plurality of different LCR elements or LCR networks and respective switches in order to provide different individual termination states. An optimized termination impedance of the inactive antenna may depend on the frequency and/or the transmitting mode of the respective antenna and the precise geometric shape of the first and the second antenna.

In one embodiment, the front-end circuit further comprises a filter that has passive elements and that is selected from: a bandpass filter, a high-pass filter, a low-pass filter. The filter is electrically connected within the signal path. The filter is at least part of the impedance element of the antenna termination circuit. The filter may be the impedance element of the antenna termination circuit.

The filter has passive elements or a plurality of passive elements that may work as a bandpass filter, a high-pass filter or a low-pass filter for one of the frequency bands of the mobile communication device. If the active antenna operates in a frequency band that is not the operative frequency band of the filter then the filter may not show a resonating behavior that generally is characterized by "zero" or "infinite" impedance (i.e., resonance and anti-resonance respectively). Thus, the filter may provide an antenna termination circuit for the inactive antenna that has an impedance that does not vary much with frequency and thus is well suited to provide a stable termination circuit.

In one embodiment, the antenna termination circuit comprises tunable capacitive elements. Such elements may be RF-MEMS capacitors having an adjustable capacity. But capacitors comprising BST (Barium-Strontium-Titanate) or a ferroelectric material are also possible. The antenna termination circuit may also comprise a bank of capacitors that are selectively connectable to the front-end circuit, e.g., by means of MEMS-switches, semiconductor switches or a solid state switch.

In one embodiment, the front-end circuit comprises a filter that is a bandpass filter working with acoustic waves. The filter is electrically connectable to an inactive one of the two antenna ports via the first antenna switch. An active antenna port transmits or receives signals in a frequency band that does not overlap with the passband of the filter.

Filters like bandpass filters that work with acoustic waves (i.e., surface acoustic waves, SAWs; bulk acoustic waves, BAWs) usually comprise electrodes being arranged on one or two surfaces of a piezoelectric substrate. The impedance behavior of a bandpass filter working with acoustic waves within the active frequency range, i.e., within the bandpass of the filter, is complex due to the electroacoustic interactions with radio frequency signals. However, in a frequency range that does not overlap with the passband of a bandpass filter, the respective filter acts as an impedance component, for example, as a capacitive component due to the electrode structure that act as electrodes of a capacitive element. As such filters are usually contained in front-end circuits for filtering radio frequency signals, the use of such filters within antenna termination circuits enables enhancing the respective antenna performance of the active antenna without the need for further integration of additional impedance components.

As miniaturization is a major aspect in designing front-end circuits, it is preferred to utilize circuit components that are already comprised in a front-end circuit and that do not make it necessary to integrate further circuit elements.

In one embodiment the front-end circuit comprises signal lines and switches where, when an antenna port is inactive while another antenna port is active, at least one inactive antenna port is electrically connectable via the first antenna switch to two termination states selected from an exclusively open-terminated state, an exclusively short-terminated state, and an exclusively individual-terminated state.

A front-end circuit that enables choosing the termination state of the inactive antenna further leads to an improved front-end circuit and to an improved communication device as the degree of freedom of the termination state is increased.

In one embodiment, the antenna termination circuit of the front-end circuit has at least two short-terminated connections to ground further comprising signal lines and antenna switches to electrically connect an inactive antenna port to at least two short-terminated connections.

It may be preferred that the termination impedance may have an absolute value that is as low as possible. Although ground may be regarded as an electromagnetic potential of zero impedance, respective electric connections usually have parasitic capacitances, parasitic and finite resistance values. By simultaneously connecting the inactive antenna port to at least two short terminated connections, the resistance between the antenna port and ground is reduced.

In one embodiment, the front-end circuit comprises two antennas connected to the respective antenna ports, the antennas being selected from a patch antenna, an inverted L antenna (ILA), an inverted F antenna (IFA), a planar inverted L antenna (PILA), a planar inverted F antenna (PIFA), and a rod antenna.

Especially patch antennas as PILAs or PIFAs have, due to their respective large patch, a stronger electromagnetic interaction compared to rod antennas.

In one embodiment, the front-end circuit is implemented and utilized in a multi-band communication device.

In one embodiment, the front-end circuit has an antenna termination circuit that provides different individual terminated states. Choosing and selecting the actual individual terminated state may be dependent on the frequency of an active antenna port, the transmission mode, the types of active and inactive antennas, the question whether an antenna transmits or receives data, the extent of interaction between active and inactive antennas.

In one embodiment of the front-end circuit, switches are selected from FET-switches (FET=Field Effect Transistor), MEMS-switches (MEMS=Microelectromechanical System), CMOS-switches (CMOS=Complementary metal-oxide-semiconductor), HEMTs (HEMT=High Electron Mobility Transistor), PHEMTs (PHEMT=Pseudomorphic High Electron Mobility Transistor), JPHEMTs (JPHEMT=Junction Pseudomorphic High Electron Mobility Transistor), SoS (Silicon on Sapphire) switches, and galvanic switches.

In one embodiment, the antenna switches of the front-end circuit are controlled by a logic circuit that is implemented in a chipset of the respective mobile communication device via GPIO (General Purpose Input Output) or SPI (Serial Peripheral Interface Bus) or RF Bus. The chipset is part of the front-end circuit.

In one embodiment, the antenna switches of the front-end circuit are controlled by use of a mode table.

Mode tables teach how to select a respective antenna termination dependent on some criteria. They allow a logic circuit to determine whether the inactive antenna is electrically connected by switches to an open-terminated state, to a short-terminated state or to one of a plurality of individual-terminated states. A mode table may consider operation frequencies of the inactive or of the active antenna. It further may consider the geometric details and the respective distance between the antennas and it further may consider the charging state of the battery. If, e.g., the battery state is low then the process of tuning the inactive antenna may be aborted in order to save energy. Or if the battery state is low then the process of tuning the inactive antenna may be intensified in order not to waste energy by mismatched antennas. Both cases are possible and may depend on the precise circumstances.

In one embodiment, the front-end circuit has a first antenna electrically connected to the first antenna port and a second antenna and electrically connected to the second antenna port. The second antenna has a resonance frequency in a first frequency band. The first antenna has a resonance frequency in another frequency band. The first frequency band may be selected from the 1 GHz frequency band and the 2 GHz frequency band. Then, the first antenna has a resonance frequency in the respective other frequency band.

A mobile communication device that is supposed to be operable in a frequency band of the 1 GHz range and in a frequency band of the 2 GHz range may comprise one antenna for each frequency band but at least two antennas. The frequency bands may overlap at least partially. The frequency bands also may not overlap.

In one embodiment, the front-end circuit is implemented in a device for wireless applications. The device may be a cellular phone, a smartphone, a Bluetooth device, a GPS receiver (GPS=Global Positioning System), a DVB-T receiver (DVB-T=Digital Video Broadcasting-Terrestrial), or a DVB-H receiver (DVB-H=Digital Video Broadcasting-Handheld). In general, the device may be a diversity receiver receiving information additional to audio information. The device may be a MIMO (Multiple Input Multiple Output) device.

A method for driving a front-end circuit includes determining at least one active antenna port, determining at least one inactive antenna port, consulting a mode table regarding optimal antenna performance, and terminating at least one inactive antenna port open, short or individual according to the mode table via selecting and setting the according switching state of the respective antenna switches.

BRIEF DESCRIPTION OF THE DRAWINGS

The present invention will become fully understood from the detailed description given herein below and the accompanying drawings.

The following list of reference symbols may be used in conjunction with the drawings:

FEM: front-end module

FEC: front-end circuit

ATC: antenna termination circuit

AS1, AS2, AS3: first, second, third antenna switch

AP1, AP2, AP3: first, second, third antenna port

SP, SP1, SP2, SP3: signal path; first, second, third signal path

AN1, AN2, AN3: first, second, third antenna

SP: signal path

IN: interaction/electromagnetic interaction

OP: open circuit

GND: ground

FI: filter

SL1, SL2, SL3: first, second, third signal line

SW1*a*, SW1*b*: first and second switch in a first signal line

SW2*a*, SW2*b*: first and second switch in a second signal line

SW3*a*, SW3*b*: first and second switch in a third signal line

M1, M2: first, second module

WD: wireless device

IL1, IL2, IL3: first, second, third frequency-dependent radiation efficiency

DETAILED DESCRIPTION OF ILLUSTRATIVE EMBODIMENTS

Figure 1:
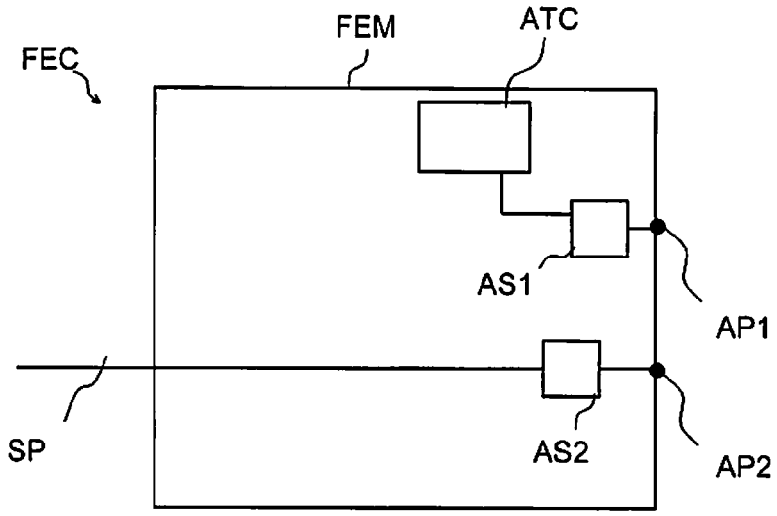
FIG. 1 illustrates circuitry according to the basic idea of the present invention.

FIG. 1 illustrates circuitry according to an embodiment of the invention. A front-end circuit FEC is comprised within a front-end module FEM. The front-end circuit FEC comprises an antenna termination circuit ATC, a first antenna switch AS1 and a second antenna switch AS2. The first antenna switch AS1 electrically connects the antenna termination circuit ATC with a first antenna port AP1. The second antenna switch AS2 electrically connects a signal path SP with a second antenna port AP2.

The first antenna port AP1 may be connected with a first antenna and the second antenna port AP2 may be connected with a second antenna. When the second antenna is in use and receives or transmits radio frequency signals via the signal path SP, the first antenna is inactive and the first antenna switch AS1 electrically connects the first antenna with the antenna termination circuit ATC in order to reduce detrimental electromagnetic interaction between the first and the second antenna.

Figure 2:
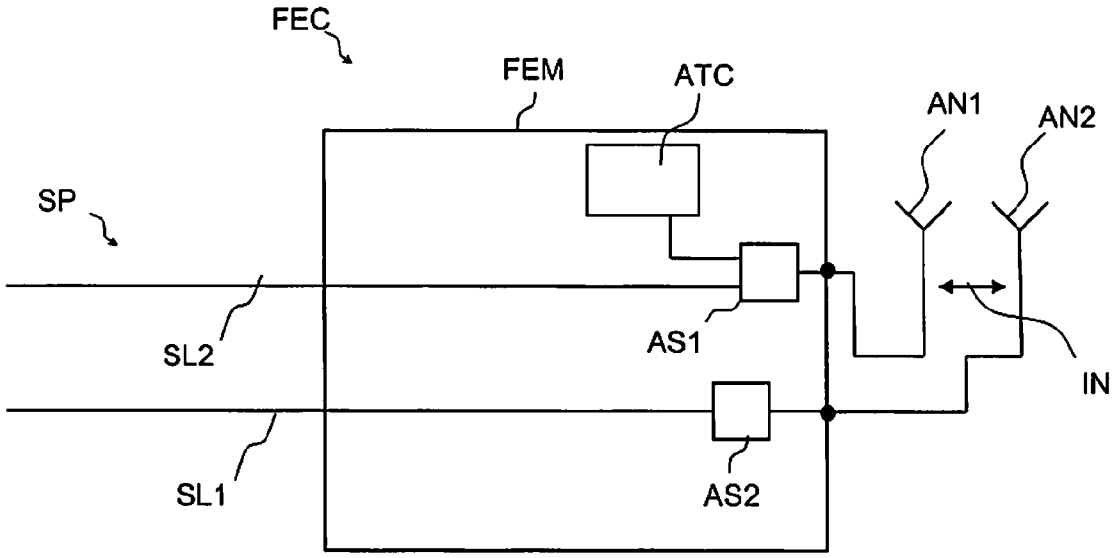
FIG. 2 illustrates the arrangement of detrimentally coupled antennas.

FIG. 2 illustrates a front-end module FEM with a front-end circuit FEC having a first antenna switch AS1, a second antenna switch AS2 and an antenna termination circuit ATC. The second antenna switch AS2 electrically connects a first signal line SL1 to a second antenna AN2. The first antenna switch AS1 electrically connects a first antenna AN1 either with an antenna termination circuit ATC or with a second signal line SL2. The signal path of the front-end circuit is comprised of the first and the second signal line SL1, SL2. "IN" denotes electromagnetic interaction between the first antenna AN1 and the second antenna AN2, at least when the second antenna AN2 is active. If there is detrimental interaction between the two antennas, then the first antenna switch preferably electrically connects the first antenna AN1 to the antenna termination circuit ATC if the first antenna is not in use, i.e., if the first antenna does not receive or transmit radio frequency signals via the second signal path SL2. The antenna termination circuit ATC improves interaction between the antennae or reduces detrimental interaction between the two antennae AN1 and AN2.

Figure 3:
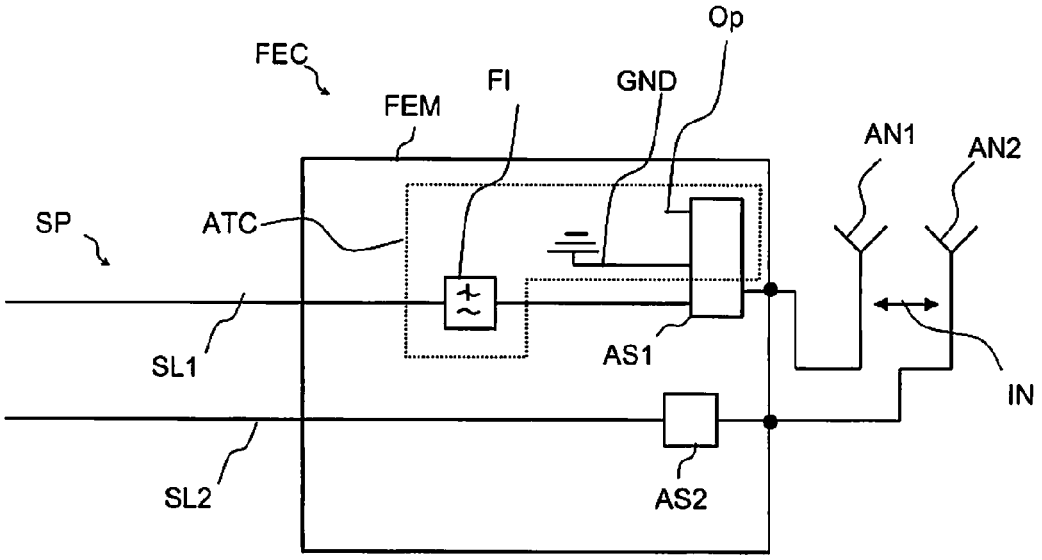
FIG. 3 illustrates an embodiment of the antenna termination circuit.

FIG. 3 illustrates an embodiment where the front-end circuit FEC comprises an antenna termination circuit ATC that is improved compared to the antenna termination circuit of FIG. 2. The antenna termination circuit ATC comprises an open port OP, a ground port GND and a radio frequency filter that may be a high pass filter or a low pass filter of the first signal path. When the second antenna switch AS2 electrically connects the second signal path SL2 to the second antenna AN2 and the second antenna AN2 is active, i.e., receives or transmits radio frequency signals via the second signal path SL2, and if the first antenna AN1 is inactive, then there are three different possible termination states for the first inactive antenna. The first antenna AN1 can be electrically connected to the open state having mainly infinite impedance, it can be electrically connected to ground GND having mainly zero impedance, and it can be electrically connected to the filter FI in the first signal path SL1 as an element of the antenna termination circuit ATC. Switching between these three states is performed by the first antenna switch AS1. Radio frequency filters that are comprised in signal paths of front-end circuits usually comprise impedance elements such as capacitive elements, inductive elements or networks comprising such passive components. If the filter FI is designed properly with respect to a good termination state, then it will provide a fixed termination impedance for the first antenna that drastically reduces negative and/or detrimental interaction between the first and the second antenna AN1, AN2.

Figure 4:
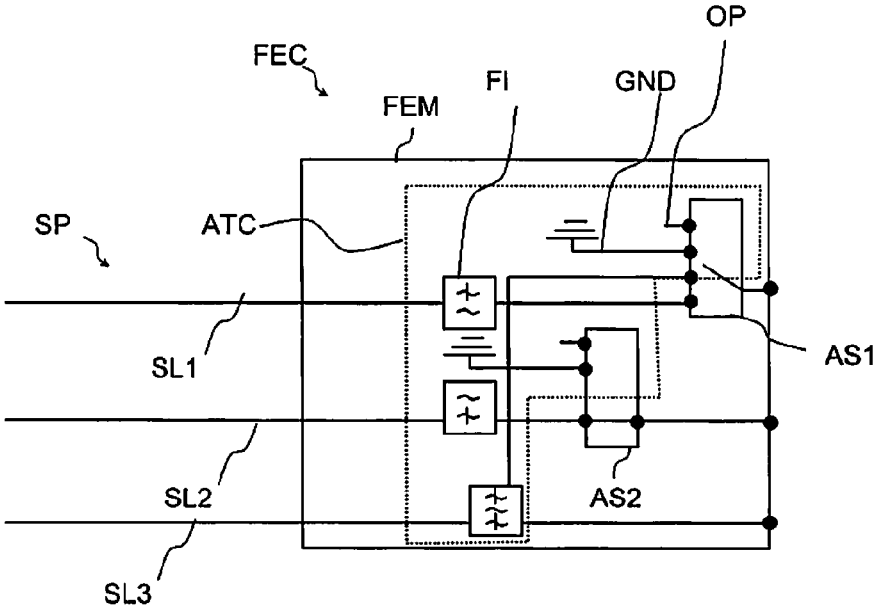
FIG. 4 illustrates a more complex embodiment of the antenna termination circuit.

FIG. 4 illustrates an embodiment of the antenna termination circuit ATC where the front-end circuit comprises a first, a second and a third signal line. In this exemplary embodiment the first signal line SL1 comprises a low pass filter, the second signal line SL2 comprises a high pass filter and the third signal line SL3 comprises a band pass filter. The first antenna switch AS1 can electrically connect the first antenna port either to an open-terminated state OP or to a ground state GND (the short-terminated state) or to at least one impedance element of the band pass filter of the third signal line (as the individual-terminated state), for example, when the second antenna is in use and the first and the third antennae are inactive. In another situation, the second antenna may be inactive and there is detrimental interaction between a second antenna being electrically connected to the second signal line SL2 and either a first antenna electrically connected to the first signal line or a third antenna electrically connected to the third signal line SL3. The second antenna switch AS2 provides the front-end circuit with the possibility of different antenna termination of the second antenna AN2. The second antenna switch AS2 can electrically connect the second antenna AN2 either to an open-terminated state, to a short-terminated state or to impedance elements of the high pass filter within the second signal line.

The embodiments illustrated in FIGS. 1 to 4 are just exemplary with respect to the basic idea of the present invention. Each antenna switch that is electrically connected to an antenna port can provide different termination states for the respective antenna. Such termination states may be selected from open-terminated, short-terminated or individual-terminated. Further, a plurality of individual-terminated states are possible.

Figure 5:
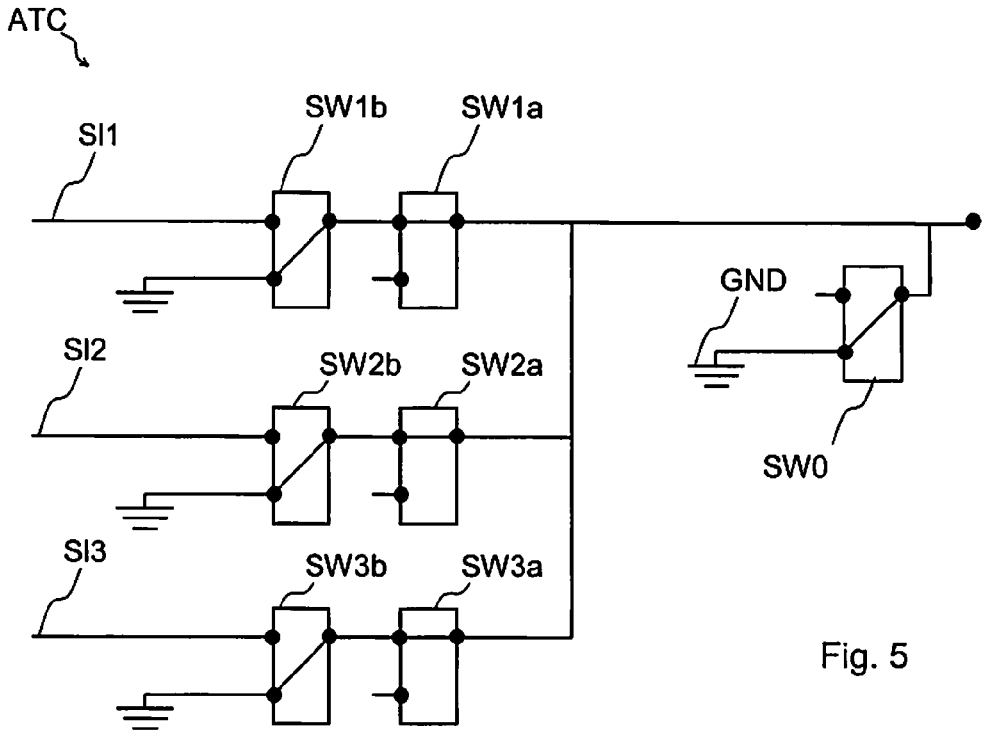
FIG. 5 illustrates details related to the switches.

FIG. 5 illustrates a part of an embodiment of an antenna termination circuit ATC comprising a plurality of switches. An antenna port can be electrically connected to a first signal line SL1 via switch SW1*a* and SW1*b* or to a second signal line SL2 via switches SW2*a* and SW2*b*. It further can be electrically connected to a third signal line SL3 via switches SW3*a* and SW3*b*. If the antenna port is to be switched to an open-terminated state, then switches SW0, SW1*a*, SW2*a* and SW3*a* have to electrically connect the antenna port to the respective open state. If the antenna port is to be connected to a short-termination state then switches SW1*a*, SW2*a* and SW3*a* have to establish the electric connection to the switches SW1*b*, SW2*b* and SW3*b*, respectively. Switches SW0, SW1*b*, SW2*b* and SW3*b* then electrically connect the antenna port to ground.

In reality, an electric connection to ground does not provide an impedance of exactly zero Ω but has a certain small finite resistance. As there are several parallel connections to a "ground" state, each of the individual ground connections contributes to decrease the absolute value of the real impedance and therefore contributes to approximating the desired zero Ω state.

Figure 6:
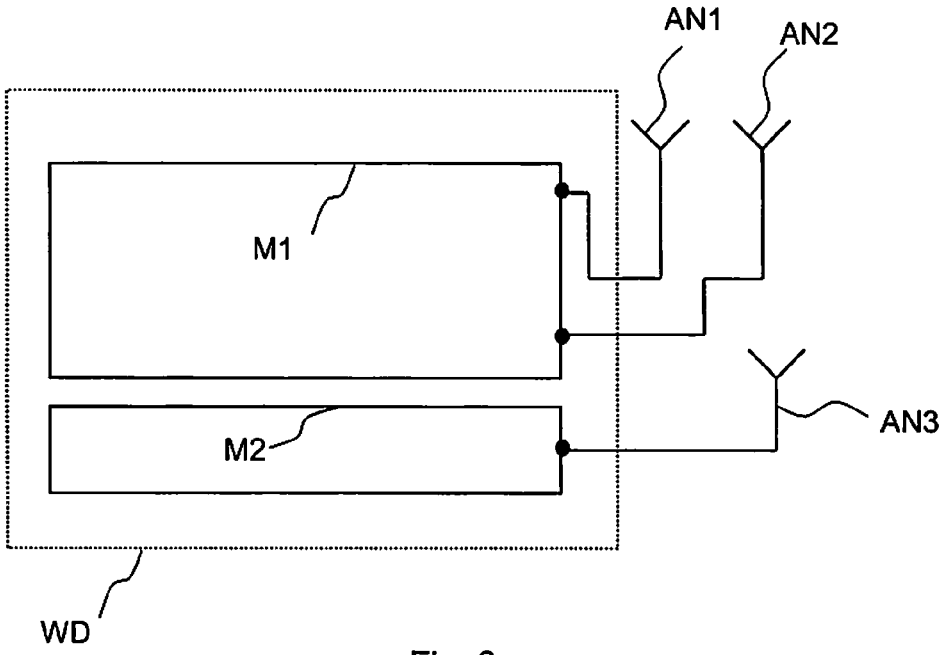
FIG. 6 illustrates an embodiment with an additional antenna.

FIG. 6 illustrates a wireless device WD utilizing a first module M1 with a first antenna AN1 and a second antenna AN2 and a second module M2 with a third antenna AN3. The first module M1 may be a front-end circuit of a mobile communication device and the second module M2 may be another wireless device, for example, a diversity/DVB-H/GPS/FM or similar receiver. The second module M2 may, thus, apply a complimentary functionality to a mobile communication device. Detrimental interaction may take place between the first antenna AN1 and the second antenna AN2, between the first antenna AN1 and the third antenna AN3 and between the second antenna AN2 and the third antenna AN3. According to the idea of the present invention each antenna can be electrically connected with an antenna termination circuit that reduces detrimental interaction of an active antenna by terminating the at least one inactive antenna that is selected from the first, the second and the third antenna.

Figure 7:
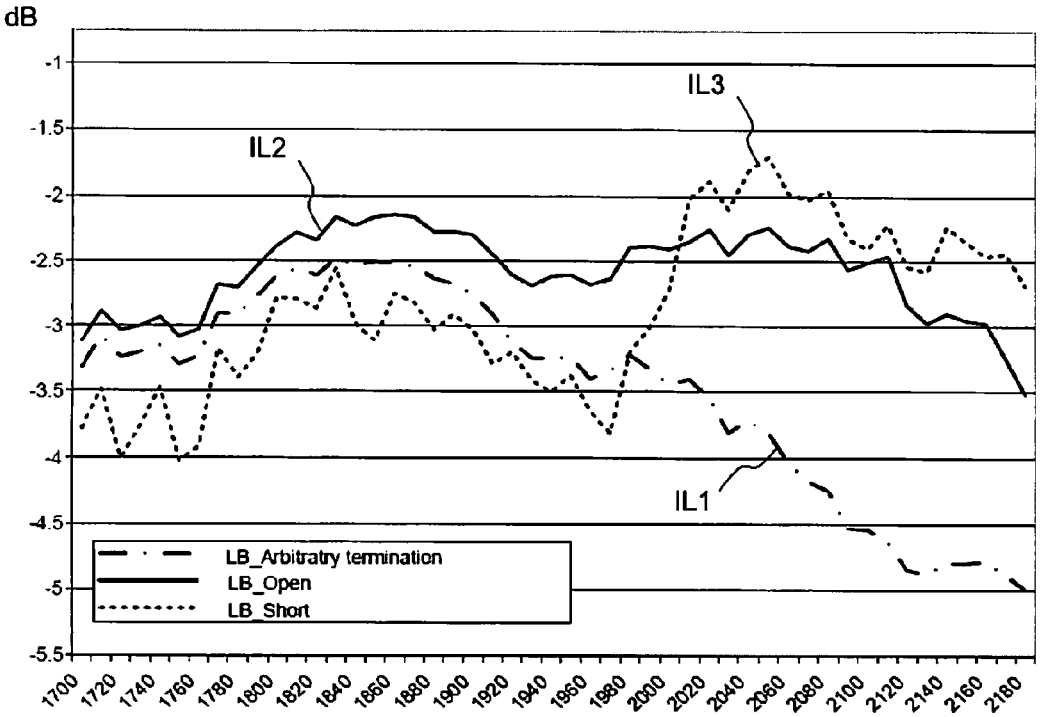
FIG. 7 illustrates the frequency-dependent radiation efficiencies [dB] on the termination state.

FIG. 7 illustrates the calculated radiation efficiency of an active antenna that is in proximity with an inactive antenna. "IL1" denotes the frequency-dependent radiation efficiency where the adjacent inactive antenna is individual-terminated; "IL2" denotes the frequency-dependent radiation efficiency while the adjacent inactive antenna is open-terminated, and "IL3" denotes the frequency-dependent radiation efficiency of an active antenna while the adjacent inactive antenna is short-terminated. As can clearly be seen, the short-termination of the inactive antenna (for example, IL3) has a high radiation efficiency at frequencies that are higher than approximately 2000 MHz but have poor, i.e., low, radiation efficiency at lower frequencies.

In contrast, the active antenna has a better, i.e., higher, radiation efficiency at lower frequencies, i.e., frequencies below 2000 MHz, when the inactive antenna is individual-terminated (IL1) but the radiation efficiency for frequencies higher than 2000 MHz is worse than the radiation efficiency IL3 and further degrades with increasing frequency.

"IL2" denotes an radiation efficiency that is optimal among the three options for frequencies lower than 2000 MHz but worse than the radiation efficiency of the open-terminated adjacent antenna according to "IL3" at frequencies higher than approx. 2000 MHz.

According to the present invention, it is possible to electrically terminate the inactive antenna for frequencies below 2000 MHz in an open-terminated state according to IL2 and to a short-terminated state for higher frequencies according to IL3.

However, in other situations it may be preferred to terminate an inactive antenna with an individually optimized impedance.

The present invention discloses means for reducing detrimental interactions between an active antenna and an inactive antenna by preferred termination states of the inactive antenna. The basic concept does not depend on details concerning antenna switches or respective antenna termination circuits. Further, the invention is not restricted to the embodiments or the accompanying figures. Especially embodiments based on different antenna termination states and/or circuits are also possible. Thus, numerous variations departing from the figures are possible without departing from the invention.

What is claimed is:

1. A front-end circuit comprising:

a first antenna port;

a first antenna switch that is electrically connected to the first antenna port;

a second antenna port;

an antenna termination circuit that is electrically connected to the first antenna switch, wherein the antenna termination circuit comprises an impedance element selected from the group consisting of a resistance element, a capacitive element and an inductive element;

a signal path configured to propagate receive signals from the first or second antenna port or transmit signal to the first or second antenna port; and a filter having passive elements coupled in the signal path, the filter comprising a band-pass filter, a high-pass filter, or a low-pass filter, wherein the impedance element of the antenna termination circuit comprises the filter;

wherein the first antenna switch is configured to electrically connect the first antenna port to the antenna termination circuit when the signal path is electrically connected to the second antenna port.

2. The front-end circuit of claim 1, wherein the impedance element of the antenna termination circuit comprises an LCR circuit.

3. The front-end circuit of claim 1, wherein the antenna termination circuit provides one or more individually selectable states chosen from an open-terminated state, a short-terminated state and an individual-terminated state.

4. The front-end circuit of claim 1, wherein the antenna termination circuit provides an individual-terminated state, wherein in the individual-terminated state, the first antenna switch electrically connects the impedance element to the first antenna port.

5. The front-end circuit of claim 1, wherein the filter comprises a high-pass filter.

6. The front-end circuit of claim 1, wherein:

the filter is a band-pass filter working with acoustic waves, the filter is electrically connectable to an inactive one of the first and second antenna ports via the first antenna switch, and an active antenna port is configured to transmit or receive signals in a frequency band that does not overlap with a pass-band of the filter.

7. The front-end circuit of claim 1, wherein the front-end circuit comprises signal lines and switches, where, when an antenna port is inactive while an other antenna port is active, at least one inactive antenna port is electrically connectable via the first antenna switch to two termination states selected from:

an exclusively open-terminated state, an exclusively short-terminated state, and an exclusively individual-terminated state.

8. The front-end circuit of claim 1, wherein the antenna termination circuit has at least two short-terminated connections to ground, the front-end circuit further comprising signal lines and antenna switches to electrically connect an inactive antenna port to at least two short-terminated connections.

9. The front-end circuit of claim 1, wherein the front-end circuit comprises two antennas selected from a patch antenna, an inverted L antenna (ILA), an inverted F antenna (IFA), a planar inverted L antenna (PILA), a planar inverted F antenna (PIFA), and a rod antenna, wherein the antennas are connected to respective antenna ports.

10. The front-end circuit of claim 1, wherein the front-end circuit is configured for use in a multiband communication device.

11. The front-end circuit of claim 1, wherein the antenna termination circuit provides different individual-terminated states, wherein an actual individual-terminated state is selected and set dependent on at least one of the following conditions:

a frequency of an active antenna port, a transmission mode, types of active and inactive antennae, whether an antenna transmits or whether an antenna receives data, and/or an extent of interaction between active and inactive antennae.

12. The front-end circuit of claim 1, wherein the first antenna switch comprises a switch selected from the group consisting of FET-switches, MEMS-switches, CMOS switches, HEMTs, PHEMTs, JPHEMTs, SoS switches, and galvanic switches.

13. The front-end circuit of claim 1, further comprising a chipset, wherein the first antenna switch is controlled by a logic circuit that is implemented in the chipset via GPIO (General Purpose Input Output) or SPI (Serial Peripheral Interface Bus).

14. The front-end circuit of claim 1, wherein the first antenna switch is controlled by use of a mode table.

15. The front-end circuit of claim 1, further comprising:

a second antenna electrically connected to the second antenna port via a second antenna switch, wherein the second antenna has a resonance frequency in a first frequency band selected from a 1 GHz frequency band and a 2 GHz frequency band; and a first antenna electrically connected to the first antenna port via the first antenna switch, wherein the first antenna has a resonance frequency in a second frequency band selected from the 1 GHz frequency band and the 2 GHz frequency band and being different from the first frequency band.

16. The front-end circuit of claim 1, wherein the front-end circuit is implemented in a device for wireless applications.

17. The front-end circuit of claim 16, wherein the device for wireless applications comprises a device selected from the group consisting of a cellular phone, a smart phone, a short-range wireless device, a GPS receiver, a DVB-T receiver, a DVB-H receiver, a diversity receiver, and a MIMO device.

18. A method for driving a front-end circuit that comprises a first antenna port and a second antenna port, a first antenna switch that is electrically connected to the first antenna port, an antenna termination circuit that comprises an impedance element and is electrically connected to the first antenna switch, a signal path configured to propagate receive signals from the first or second antenna port or transmit signal to the first or second antenna port, and a filter coupled in the signal path, wherein the impedance element of the antenna termination circuit comprises the filter, the method comprising:

identifying an active antenna port of the front-end circuit;

identifying an inactive antenna port of the front-end circuit;

consulting a mode table regarding antenna performance; and terminating the inactive antenna port open, short or individual according to the mode table by selecting and setting a switching state an antenna switch associated with the inactive antenna port, wherein identifying the active antenna port comprises identifying the second antenna port and wherein identifying the inactive antenna port comprises identifying the first antenna port, and wherein terminating the inactive antenna port comprises causing the first antenna switch to electrically connect the first antenna port to the antenna termination circuit when the signal path is electrically connected to the second antenna port.

19. The front-end circuit of claim 1, wherein the filter comprises a low-pass filter.

* * * * *